United States Patent [19]

Gregory, Jr.

[11] 3,978,962

[45] Sept. 7, 1976

[54] SOLID STATE, COIN ACTIVATED MECHANISM

[75] Inventor: Lester Gregory, Jr., St. Petersburg, Fla.

[73] Assignee: International Acceptor Corporation of Florida, St. Petersburg, Fla.

[22] Filed: Apr. 21, 1975

[21] Appl. No.: 569,992

[52] U.S. Cl. ..... 194/97 A

[51] Int. Cl.[2] ..... G07F 3/02

[58] Field of Search ..... 133/3 D, 8; 194/97 A, 194/4 C, 102, 97, 100, 10, 1 K; 209/111.7; 235/92 CN

[56] References Cited

UNITED STATES PATENTS

| | | | |
|---|---|---|---|
| 3,086,536 | 4/1963 | Klopp | 133/8 R |
| 3,126,081 | 3/1964 | Dolman | 194/102 X |
| 3,782,543 | 1/1974 | Martelli | 209/111.7 X |

*Primary Examiner*—Stanley H. Tollberg
*Attorney, Agent, or Firm*—Shoemaker and Mattare, Ltd.

[57] ABSTRACT

A solid state, coin activated mechanism comprises a rejector for improper coins or slugs and the like, and the rejector includes a coin infeed chute with a LED or the like and a light sensitive device positioned at one side of the chute pointing angularly toward one another and toward the path of advancement of a coin in the chute, such that a bona fide coin with an irregular surface will intercept the light from the LED and the like and reflect the light to the light sensitive device, which in turn energizes a gate mechanism associated with the chute to pass a bona fide coin and to reject coins or slugs and the like which do not have the proper reflectivity and irregular surface. In one form of the invention, the chute includes a side wall inclined to the vertical and an inclined track along a bottom edge thereof along which coins roll when fed to the rejector. A stop surface is at an upper edge of the side wall and openings are formed through the side wall, to halt progression through the mechanism of coins and the like which are not of a predetermined size. In another form of the invention, a plurality of LEDs or the like, and a corresponding number of operatively associated light sensitive devices are disposed on respective opposite sides of the chute, at different distances from the track and spaced apart axially along the chute, to detect coins of different size rolling along the track and effect actuation of other devices in the mchanism to pass bona fide coins and to reject improper coins and slugs and the like.

24 Claims, 23 Drawing Figures

SOLID STATE, COIN ACTIVATED MECHANISM

BACKGROUND OF THE INVENTION

This invention relates to control means for coin operated or actuated devices, and in particular, to a rejector for use in vending machines and the like, or other devices which are coil or check actuated.

There are millions of such devices in use in the world today to control everything from candy vending machines and the like to copiers and telephones and the like. Thus, the amount of money handled by such devices is enormous, and accordingly, it is very important that a reliable and economical means be provided to accurately discriminate between coins of proper value and coins or slugs and the like which are not of the proper value to actuate or activate the device or mechanism, and all such devices presently in use have some means of effecting discrimination or selection of the proper coins, even if such means merely comprises a predimensioned slot or opening through which only certain coins can be fed. Other devices include sophisticated and expensive mechanical components and/or electrical components, which operate to discriminate between coins on the basis of both size and material content. However, most, if not all, such prior art devices will accept and fail to discriminate between some coins of improper value or slugs and the like. For example, some foreign coins are substantially identical in size and shape to American coins, and accordingly, these foreign coins will activate many of these prior art devices, thus resulting in a substantial loss to persons operating the machines due to the loss of goods and/or services due to the acceptance of the improper coins and the like. Moreover, there are many types of counterfeit coins or slugs in use today, and some of these counterfeit coins or slugs are very difficult to discriminate in conventional coin activated mechanism or rejectors. Further, the more complex a mechanism is made in order to render it capable of discriminating between proper and improper coins and the like or to reject counterfeit coins or slugs and the like, the more expensive and less reliable it becomes.

A device or means is thus desirable which is both economical in construction and reliable in operation, and which is operative to reject improper coins or slugs and the like and to discriminate between coins of proper and improper value and to pass those coins of proper value to cause actuation of a mechanism to dispense a certain goods or service, as the case may be.

OBJECTS OF THE INVENTION

Accordingly, it is an object of this invention to provide a solid state, coin activated mechanism which is economical in construction and reliable in operation, and which has a minimum of moving parts, and yet which is capable of discriminating between coins of proper and improper value and of rejecting coins and slugs and the like which are not bona fide or proper to activate the mechanism.

Another object of the invention is to provide a coin rejector which is attachable to and usable with conventional existing coin activated mechanisms.

A further object is to provide a coin rejector as above, which is economical in construction and reliable in operation and is capable of rejecting most, if not all, slugs and coins of improper value presently in use.

A still further object of the invention is to provide a coin rejector which includes an inclined coin feed chute along which coins and the like are fed to the device, and which as a light emitting means and a light sensitive means disposed closely adjacent one another at one side of the chute and pointed such that when an acceptable coin and the like moves therepast, light is reflected from the coin and the like to the light sensitive means to produce a signal, to thus cause operation of gate means to enable passing of a proper coin into the mechanism to cause activation of the same.

A still further object of the invention is to provide a coin rejector for use with conventional existing coin activated mechanisms, wherein means is provided for stopping advancement of coins and slugs and the like of improper value and returning the coins to a coin return means.

Yet another object of the present invention is to provide a coin rejector which includes means for releasing coins or slugs and the like which may become jammed in the infeed chute thereof, to thus reduce the frequency of service calls and the like required for the mechanism.

DETAILED DESCRIPTION OF THE INVENTION

Figure 1:
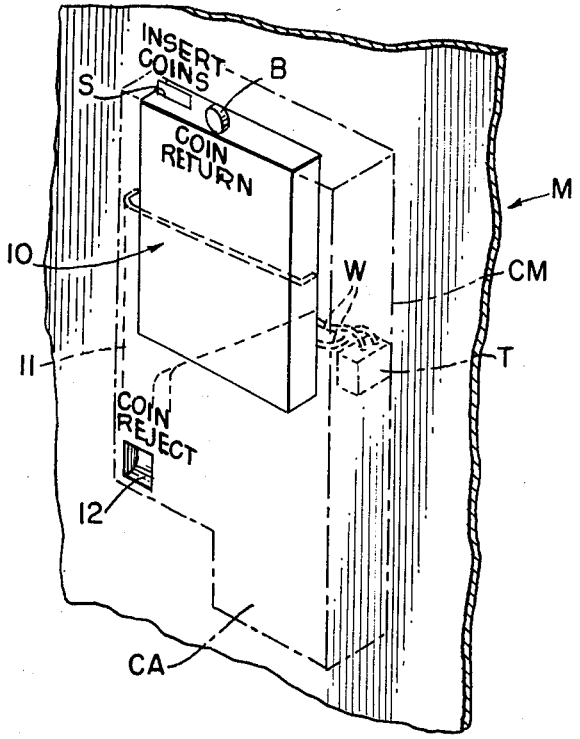
FIG. 1 is a fragmentary, somewhat schematic, perspective view of a portion of a machine for dispensing goods or services and the like, and having a coin activated mechanism therein indicated in dot and dash lines for controlling operation of the machine, and wherein a coin rejector according to the invention is shown in full lines associated with the coin activated mechanism.

In the drawings, wherein like reference numerals indicate like parts throughout the several views, a portion of a coin activated mechanism or a machine, such as a vending machine or the like, is indicated generally at M, and a substantially conventional coin controlled means CM is suitably supported in the machine M and is connected in a well known and conventional manner with the machine to control operation of the dispensing of a goods or service or other means as desired.

The coin controlled means CM includes a coin accumulator section CA at a lower portion thereof for accumulating coins of the proper value which are fed to the coin controlled means CM through a coin insert slot S positioned immediately above the coin controlled means CM.

A coin rejector 10 in accordance with the invention is operatively associated with the coin controlled means CM and is designed to be readily attached to existing conventional coin controlled means CM without requiring modification thereof. In this regard, a transformer T is shown associated with the coin controlled means CM, and the rejector means 10 or coin activated mechanism or discriminator is operatively connected thereto by means of wires W or the like.

A coin return housing 11 is operatively supported on the front of the coin rejector 10 for catching and guiding or conveying coins to a coin reject or return opening 12 in the front of the machine M. A coin return button B is provided adjacent the top of the rejector 10, whereby coins or slugs of improper value and the like or those which become lodged in the rejector 10 may be released for return to the coin reject opening 12. For example, if the power is off to the machine M for one reason or another, or the machine is inoperative or bent coins are fed thereto, or coins or slugs and the like of improper value are inserted through the slot S, they will be returned to the coin reject opening 12.

Figure 2:
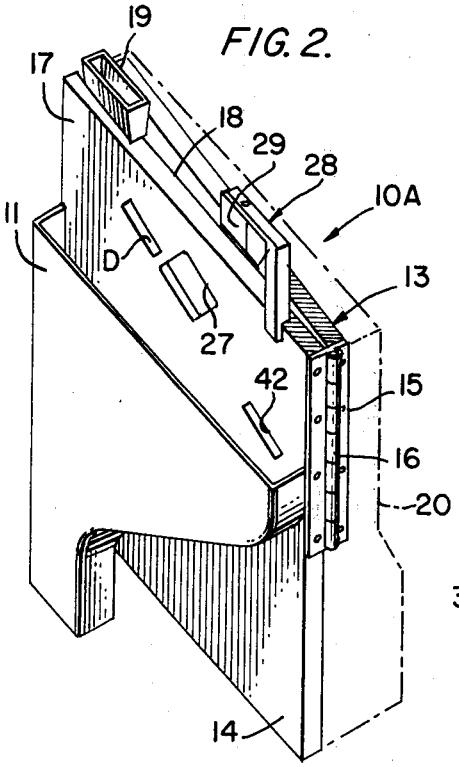
FIG. 2 is a front perspective view of a first form of coin rejector.
Figure 8:
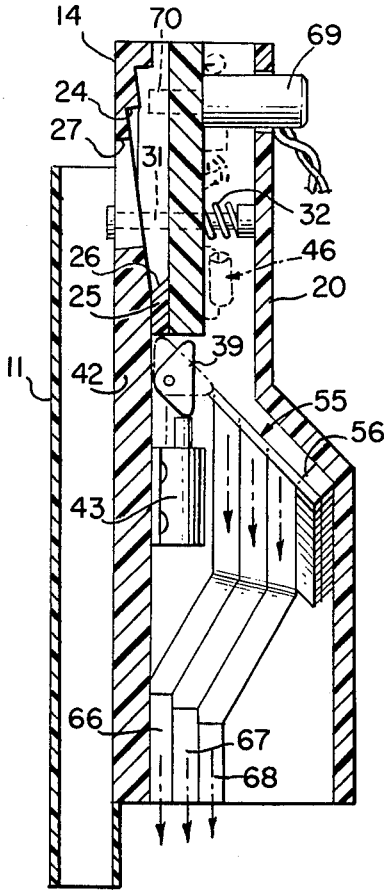
FIG. 8 is a view in section taken along line 8—8 of FIG. 7.
Figure 9:
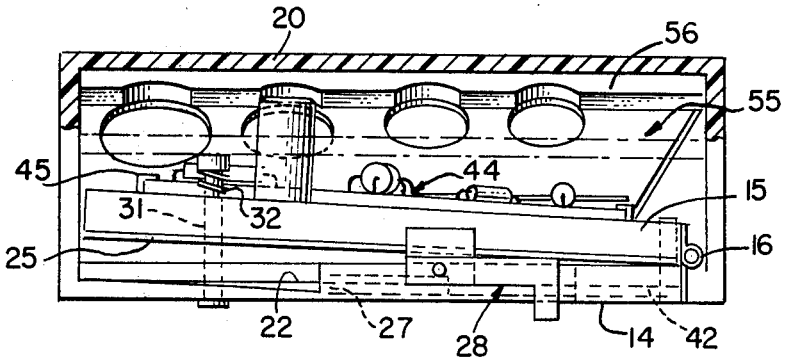
FIG. 9 is a plan view with portions in section taken along line 9—9 of FIG. 7.
Figure 10:
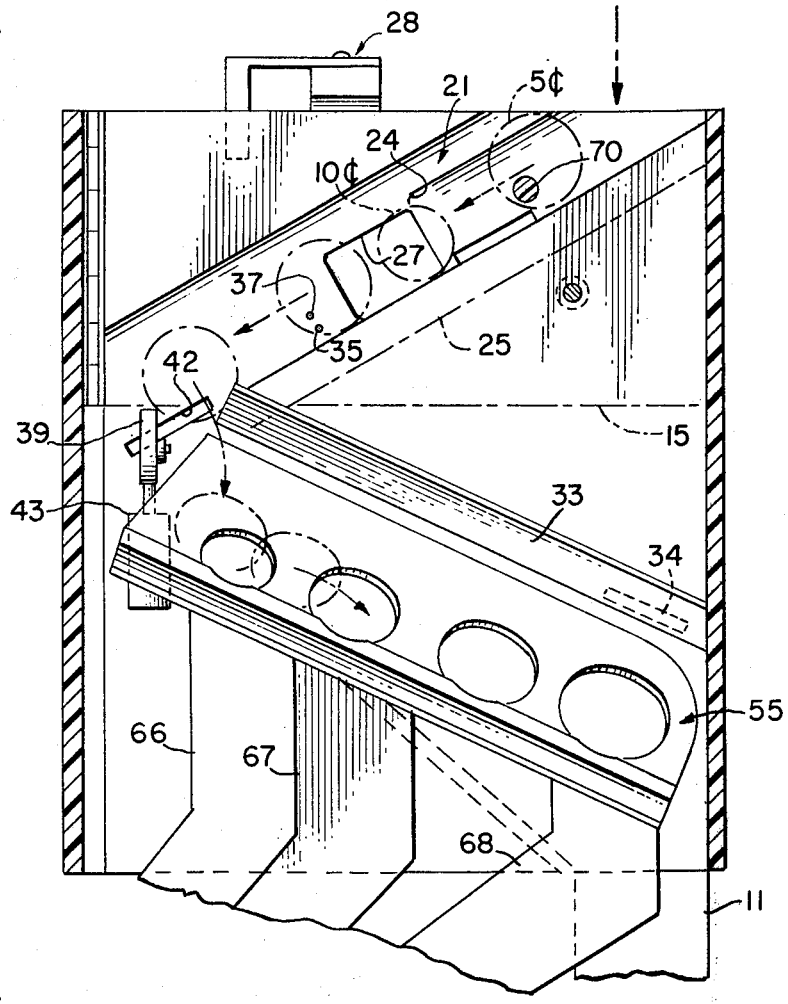
FIG. 10 is a rear view in elevation of the rejector of FIG. 7, with the cover plate removed, and illustrating the manner in which a coin moves along the feed chute and past a gate onto a dropout platform.
Figure 11:
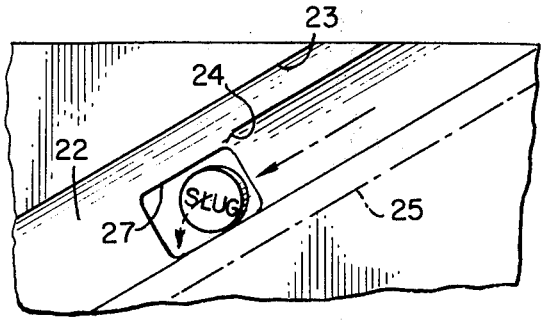
FIG. 11 is an enlarged, fragmentary view of a portion of the feed chute of FIG. 10, showing the manner in which a slug of small size is caused to drop out through an opening in one side of the chute.
Figure 12:
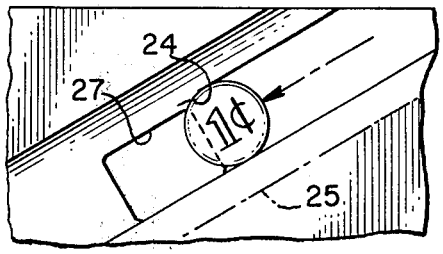
FIG. 12 is a view similar to FIG. 11, showing the manner in which a coin of improper value is stopped by the stop surface associated with the side wall of the chute.
Figure 13:
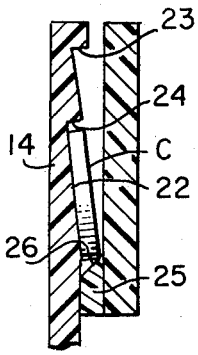
FIGS. 13 and 14 are somewhat diagrammatic, enlarged views in section of a portion of the front plate and back at the chute, showing the manner in which coins of the same diameter, but of different thickness, and thus of different value, are enabled either to move down the chute unimpeded or are caused to engage the stop surface and thus be rejected.
Figure 14:
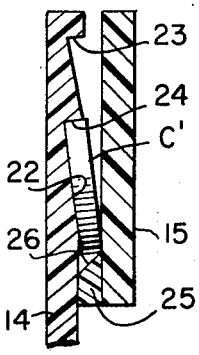
Figure 15:
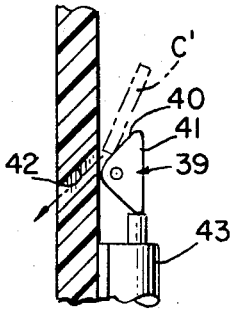
FIGS. 15 and 16 are somewhat diagrammatic, enlarged views in section of a portion of the rejector, showing the operation of the gate means in FIG. 15 to reject a coin of improper value, and in FIG. 16 to divert a coin of proper value further into the mechanism onto the coin dropout platform.
Figure 16:
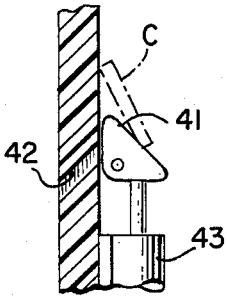

As seen in FIG. 2, a first form of rejector 10A comprises a housing 13 having a substantially rectangularly shaped front plate 14 and a somewhat smaller rectangularly shaped back plate 15 pivotally connected to the front plate by means of a hinge or the like 16 along one edge thereof. The front plate 14 has a front surface 17 and a rear surface 18, and the coin return cover 11 is suitably mounted to the front surface 17 of front plate 14. A coin guide means 19 is supported by the front plate 14 in a position corresponding with the slot S, whereby coins inserted through the slot S will enter the guide 19 and thus be led into the upper end of a coin feed chute. A cover 20 is preferably suitably mounted to the housing in covering relationship to the back plate 15 to protect the electrical components of the rejector and to enclose the coin dropout platform and chutes and in general provide a neater, more compact appearance for the rejector.

the coin feed chute 21 is seen best in FIGS. 4–16, and comprises a recessed portion in the rear face or surface of front plate 14 leading from the upper edge thereof at coin guide 19 downwardly to a side edge thereof adjacent the hinged connection with back plate 15. The chute 21 includes an inclined side wall 22 which terminates at its lower edge in the rear surface 18 of the front plate 14, and which has an upper edge or shoulder 23 spaced a distance above the bottom edge of side wall 22 a distance slightly greater than the diameter of a quarter. A coin stop surface or abutment 24, defined by a shoulder formed in the side wall 22 spaced below the shoulder 23, is spaced upwardly from the bottom edge of the side wall a distance greater than the diameter of a dime, but less than the diameter of a nickel. A coin support track 25 is carried by the back plate 15 in a position to register with the bottom edge of side wall 22, and as seen in FIG. 8, for example, when the back plate is in its operative position, the track 25 is engaged against the rear surface 18 of front plate 14 to provide support for a coin rolling along the chute. The track has a tapered or inclined upper surface 26, such that, as illustrated in FIG. 13, a coin C of the proper value, such as, for example, a dime, will ride lower upon the surface 26 of track 25 in a predetermined position and thus will miss the stop surface 24 and will continue advancing down the chute, whereas, as seen in FIG. 14, a coin C' of improper value, as for example, a foreign coin or slug or the like having the same diameter as coin or dime C, but having a different thickness, rides higher on the surface 26 of track 25 and thus engages the stop surface 24 and its advancement down the chute is halted. Also, as illustrated in FIG. 12, a penny is shown engaged with the stop surface 24 and thus its advancement down the chute is halted. In other words, the penny has a diameter larger than the dime, but smaller than a nickel, and accordingly, is not large enough for the upper edge of the penny to ride on the side wall above stop surface 24 and is too large to roll beneath the stop surface.

An opening 27 is formed through the side wall 22 and through the front plate 14 and extends upwardly from the bottom edge of the side wall to just below the lower edge of stop surface 24. The height of opening 27 above the bottom edge of side wall 22 is just slightly less than the diameter of a dime, such that as illustrated in FIG. 11, a coin or slug and the like smaller in diameter than a dime will fall through the opening 27 to the coin return cover or means 11, and thence to the coin reject opening 12. Also, a drain hole or opening D is formed through the side wall 22 just ahead of opening 27 and immediately above the track 25, so that dirt and mositure and the like which may enter the chute is enabled to fall harmlessly through opening D.

In order to free coins lodged against the stop surface 24, or bent coins and the like which will not roll down the chute 21, a coin release mechanism 28 is carried by the front plate 14 and includes a wedge-shaped member 29 disposed in a position to move between the upper edge of front plate 14 and back plate 15 and carried by a resilient leaf spring type member or the like 30, and when in use, disposed in operative relationship with coin return button B, such that operation of coin return button B causes depression of member 29 and insertion thereof between the front and back plates 14 and 15 to move the track 25 away from the chute 21, and thus let a coin or the like lodge in the chute fall past the track. A pin 31 is carried by the front plate 14 and extends through an opening in the back plate 15 and has coil spring 32 associated therewith to resiliently urge the back plate toward the front plate to maintain the track 25 resiliently engaged against the rear surface 18 of front plate 14 to support coins rolling down the chute.

A coin return rail 33 is suitably affixed to the rear surface 18 of front plate 14 below the chute 21, and the coin return rail 33 is inclined in a direction opposite to the direction of inclination of chute 21, and a coin return slot 34 is formed through the front plate 14 adjacent the lower end of coin return rail 33, such that when the wedge member 29 is depressed to move the back plate 15 and rail 25 away from the front plate 14, a coin or the like drops onto the rail 33 and is guided along the rail to the coin return slot 34 and through the coin return slot to the coin return cover or housing 11 and thence to the coin reject opening 12.

Thus, with the structure as thus far described, coins or slugs and the like smaller in diameter than a dime will fall through the opening 27 to the coin return and coins having the same diameter as a dime, but thicker than a dime, will be caused to engage the stop surface 24 and thus will lodge in the chute and may be released upon depression of coin return button B, whereby the coins will return to the coin return opening 12. Similarly, any coin or slug and the like larger in diameter than a dime but smaller in diameter than a nickel will engage the stop surface 24 and may be released for return to the opening 12, as described above. Any coins or slugs and the like at least as large in diameter as a nickel will, therefore, continue to roll down the chute, and also any coins or slugs and the like which have the same size and shape as a dime will continue to roll down the chute.

Figure 17:
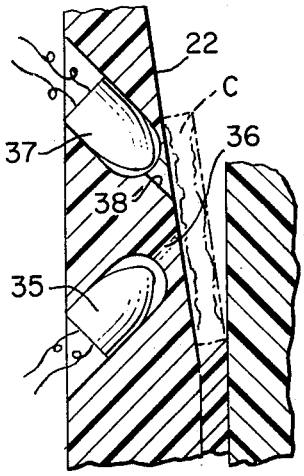
FIG. 17 is a greatly enlarged, framentary view in section of a portion of the feed chute, and showing the light emitting means and light sensitive means associated with the chute to detect the reflectivity of a coin and the like moving therepast to generate a signal in response to movement of a bona fide coin of proper value therepast.

Accordingly, in order to insure that only bona fide coins of the proper value will cause activation of the coin controlled means, an LED 35 is positioned at side wall 22 of chute 21 spaced upwardly from the bottom edge of the side wall approximately ¼ inch and pointed angularly upwardly, as illustrated in FIG. 17, whereby light emitted by the LED is caused to shine through an opening 36 in the side wall 22. A light sensitive means, such as a phototransistor 37 or the like, is also disposed adjacent an opening 38 in the side wall 22 spaced immediately above opening 36, such that a bona fide coin C having an irregular surface thereon and a predetermined reflectivity will cause the light from the LED 35 to be reflected to the light sensitive means 37, and thus produce a signal. On the other hand, slugs and the like having smooth surfaces will not reflect the light, since such slug and the like will lie flat against the side wall 22 and block the openings 36 and 38. Similarly, a slug or coin and the like which does not have the proper brilliance or reflectivity will not reflect sufficient light to the phototransistor 37 to turn it on.

A suitable gate means 39 is pivotally mounted to the front plate 14 at the lower edge of side wall 22 at the bottom end of chute 21, and has a pair of surfaces 40 and 41 selectively movable toward and away from the side wall to a first position to deflect a coin moving down the chute through a coin return slot 42 and to a second position to deflect a coin onto a coin dropout platform, described hereinafter.

Suitable gate operating means, such as solenoid 43, is operatively connected with the gate 39 to operate the gate between its first and second positions.

Figure 3:
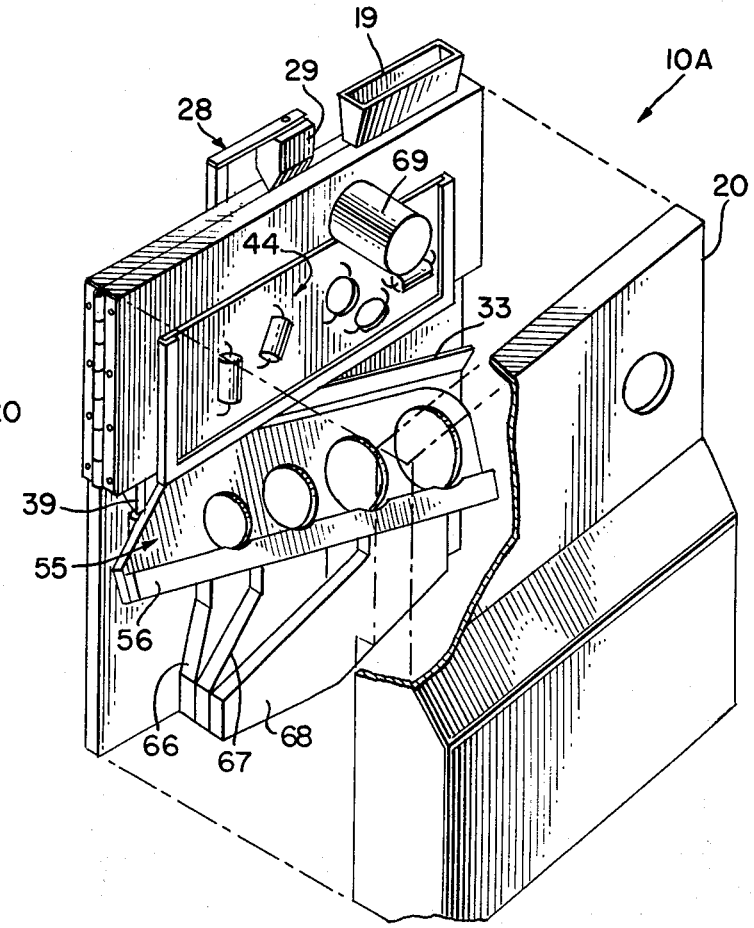
FIG. 3 is a rear perspective view of the coin rejector of FIG. 2, with a rear cover plate thereof removed.
Figure 4:
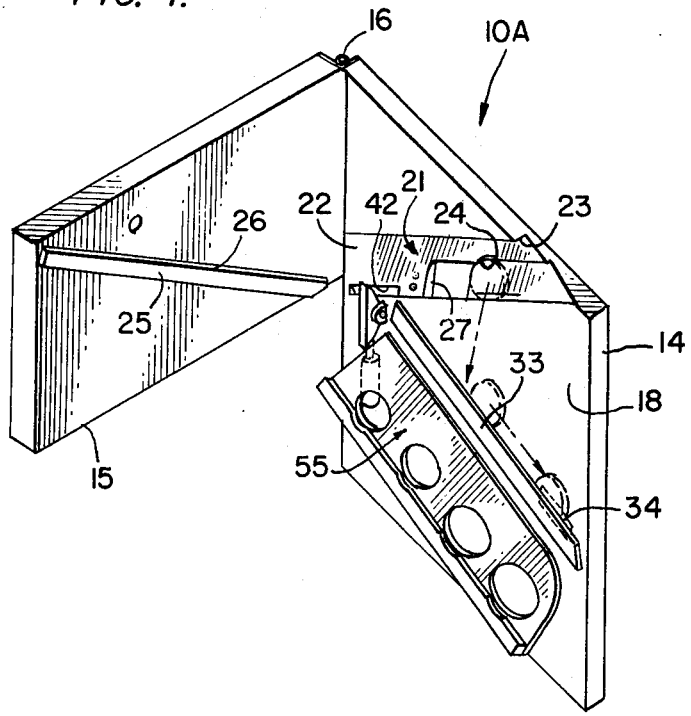
FIG. 4 is a diagrammatic, perspective, rear view of a portion of the rejector of FIG. 2, showing the front and rear plates thereof moved apart to illustrate the manner in which a lodged coin or slug and the like is freed for return to a coin reject means.
Figure 5:
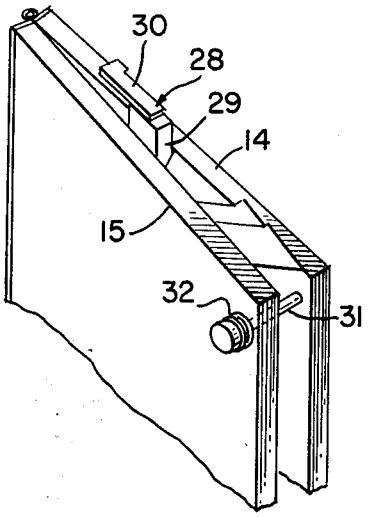
FIG. 5 is a fragmentary, perspective view of the mechanism of FIG. 4, illustrating the manner in which a coin return means is operated to move the front and back plates of the rejector apart to release the coin, as shown in FIG. 4.
Figure 6:
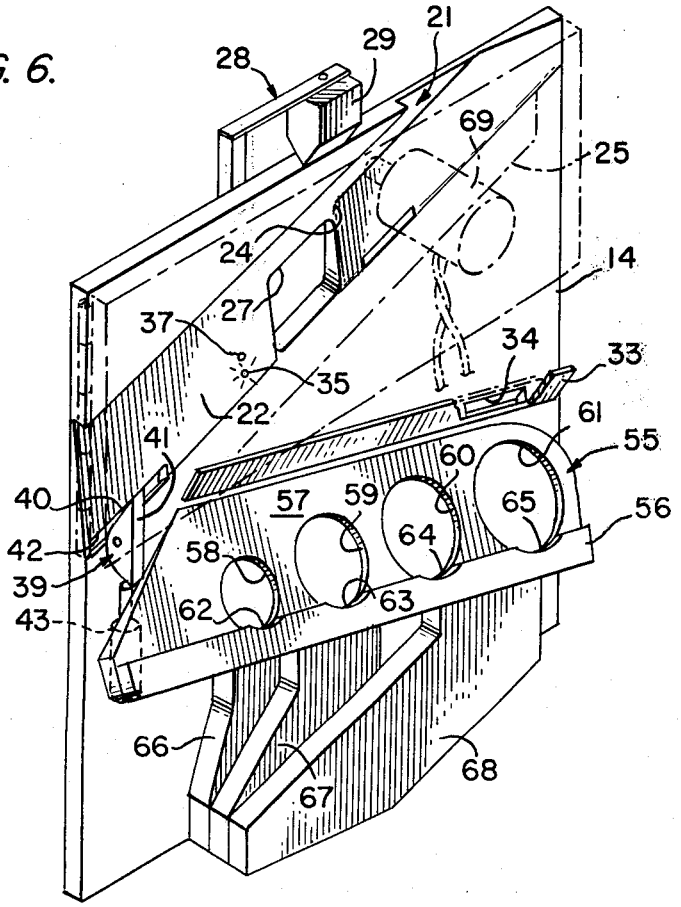
FIG. 6 is a slightly enlarged, rear perspective view similar to FIG. 3 of the rejector, with the rear plate and solid state circuitry removed for the purpose of viewing the coin feed chute and the like carried by the front plate of the rejector.
Figure 7:
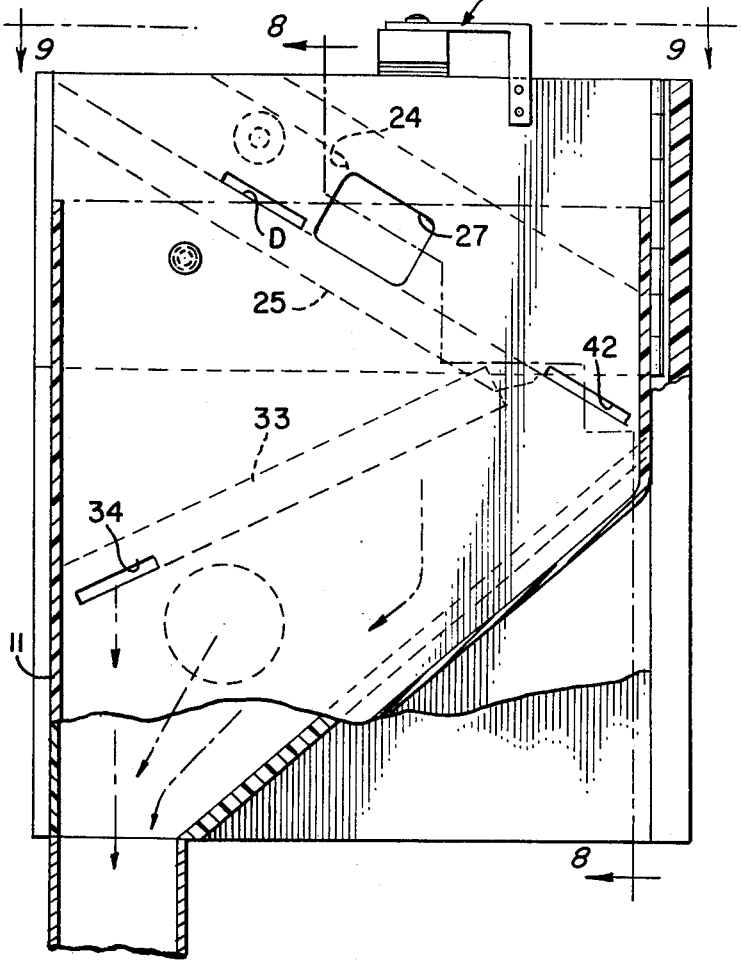
FIG. 7 is a front view in elevation, with portions broken away, of the first form of the invention, and showing the arrangement of coin stop surfaces and coin return slots and the like in the front plate.
Figure 18:
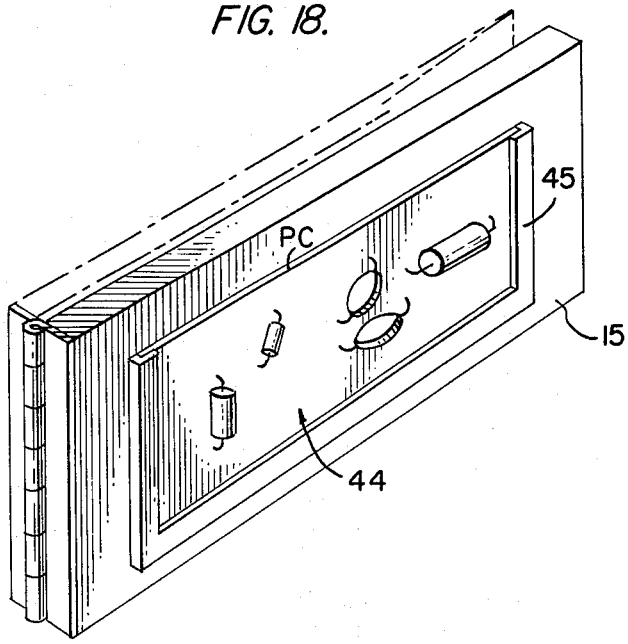
FIG. 18 is an enlarged, perspective view of a portion of the rejector, showing the movable back plate having the mounting means for removably supporting a printed circuit board thereon for the solid state circuitry.
Figure 19:
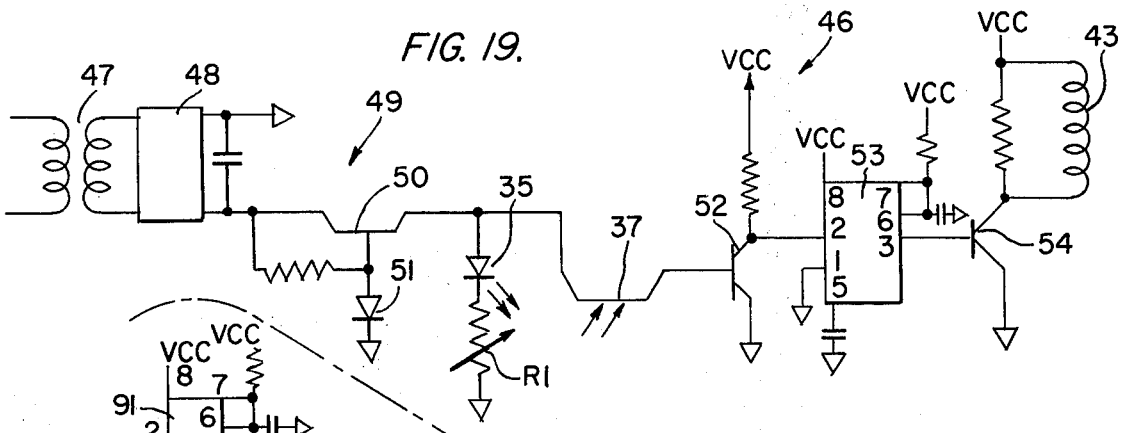
FIG. 19 is a diagram of the circuit used in the form of the invention illustrated in FIGS. 2–18.

As seen in FIGS. 3, 18 and 19, suitable control means 44 is provided for controlling operation of the solenoid 43. The control means comprises a solid state circuit mounted on a printed circuit board PC carried in a substantially U-shaped retaining channel 45 mounted on the back face or surface of rear plate 15. The solid state circuit 46 comprises a transformer 47 which steps the 110 volt AC power supply down to 12 volts AC, and a bridge 48 which rectifies the 12 volts AC to the 12 volts DC. The bridge is connected to a line voltage regulator 49 comprising a power transistor 50 and Zener diode 51. Power is supplied from the regulator to LED 35 and phototransistor 37, such that when a coin interrupts or reflects light from the LED 35 to the phototransistor 37, the phototransistor is caused to go positive, sending a pulse to transistor 52, which is thus fired sending a negative signal to a 555 timer 53, which in turn gives out an output to a transistor 54 to turn transistor 54 on and thus cause energization of solenoid 43 to operate gate 39 to its said second position, and thus divert a coin onto the dropout platform.

The dropout platform 55 is inclined in a direction opposite to the direction of inclination of chute 21 and has a coin support rail 56 along the lower edge thereof and an inclined side wall 57, such that coins deflected by the surface 41 of gate 39 onto the dropout platform roll along the track 56 in sliding engagement with sidewall 57. A plurality of openings 58, 59, 60 and 61 are formed through the dropout platform 55 corresponding size and shape, respectively, to a dime, a nickel, a coin or slug larger than a nickel and smaller than a quarter, and a quarter. The upper surface of track 56 is formed with a plurality of shallow depressions or concavities 62, 63, 64 and 65 in registration with the respective openings 58, 59, 60 and 61, whereby a coin rolling along the track 56 is momentarily impeded by the depressions to facilitate its falling through a respective opening of the proper size.

Thus, when a coin or slug and the like is inserted through the slot S and guided by the coin guide 19 to the upper end of chute 21 for movement along the chute, any coin having a size smaller than a dime will fall through the opening 27 to the coin return, and any coin having a size between a dime and nickel will be stopped by the stop surface 24, and upon operation of coin return button B, will be returned to the coin return 12. Further, any coin which does not have the proper reflectivity as sensed by the LED 35 and light sensitive means 37 will be diverted through slot 42 to the coin return means. If for any reason a coin or slug and the like which has a size between a nickel and a quarter, and which also has the proper reflectivity, is diverted by the gate 39 onto the dropout platform 55, it will fall through the opening 60, and thence to the coin return means 12.

Accordingly, with the particular device illustrated and described, only bona fide dimes, nickels and quarters will reach the coin dropout chutes 66, 67 and 68 in registry, respectively, with the dime opening or hole 58, the nickel opening 59, and the quarter opening 61. All other coins or slugs and the like will be returned to the coin reject or return opening 12.

Moreover, and referring again to FIG. 19, the sensitivity of the LED and phototransistor can be adjusted by varying the resistance R1, whereby the device may be tuned to accept or reject coins of different reflectivity with a great degree of accuracy. Moreover, the operation of the gate 39 is such that in the event the power is off to the machine, or if for some other reason the machine is inoperative, all coins fed to the chute will automatically be returned through the slot 42 to the coin return.

As noted previously, and as indicated in FIG. 1, the rejector 10 is an attachment for a conventional coin operated or controlled mechanism CM and the coin operated mechanism CM may include various devices or electrical circuits and the like for making change from change holders built into the coin operated mechanism CM. However, a solenoid 69 is provided on the back 15 having a plunger 70 extended through the back plate and operatively connected with the change making portion of the mechanism CM, such that when there is not sufficient change, the plunger 70 is extended into the chute 21 in the path of advancement of a quarter therein to stop advancement of the quarter, and thus enable a person to push the coin return button B and release the quarter for return through the opening 12.

Figure 20:
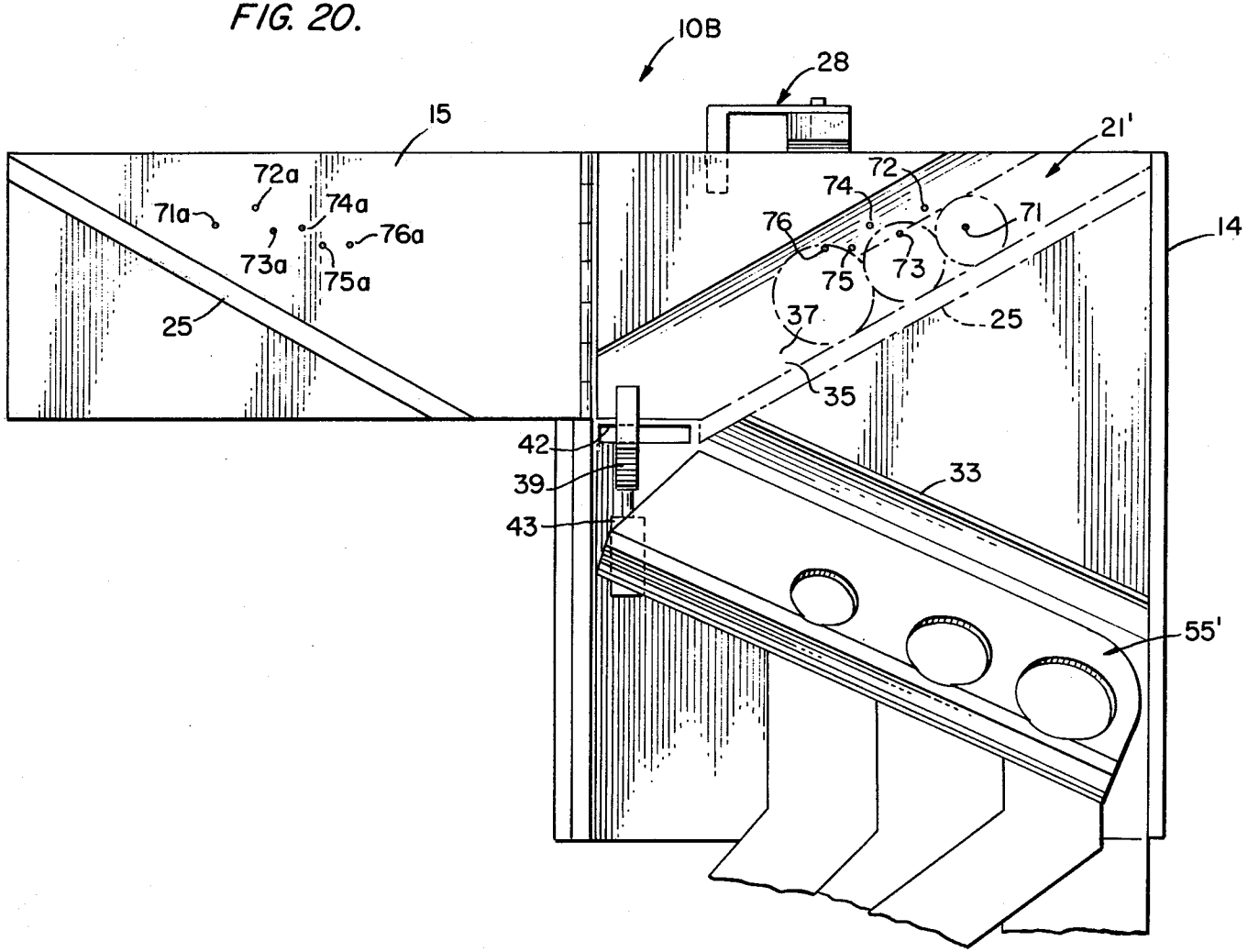
FIG. 20 is an enlarged view of a modified rejector according to the invention, showing the back plate pivoted away from the front plate for clarity of viewing the parts therein, and showing a plurality of light emitting means associated with the chute for discriminating between coins of proper and improper value entirely through the use of electronic means, and without reliance upon the mechanical means of FIGS. 2–18.

A modified rejector 10B is illustrated in FIG. 20, and includes a modified coin feed chute 21′ which is devoid of the opening 27 and stop surface 24, as in the previously described embodiment, but which includes the remaining structure as described with reference to FIGS. 2–18. In lieu of the openings and stop surfaces of the previously described embodiment, electronic means is provided in this form of the invention for discriminating between different sizes of coins and slugs and the like to accept only the proper size and thus value of coins. The electronic means includes six LEDs or other suitable light emitting devices 71, 72, 73, 74, 75 and 76 disposed in axially spaced apart relationship along the chute and each spaced a predetermined distance from the track 25, and a plurality of light sensitive devices, such as phototransistors or the like 71*a*, 72*a*, 73*a*, 74*a*, 75*a* and 76*a* are provided at the opposite side of the chute in registry with the LEDs or the like. More particularly, LED 71 and its associated phototransistor 71*a* are positioned nearest the entrance to the chute and are spaced upwardly from the track a distance approximately equal to the midpoint of a dime or the like. LED 73 and its associated phototransistor 73*a* are spaced axially farther along the chute and are spaced upwardly from the track a distance just slightly less than the diameter of a dime. LED 72 and its associated phototransistor 72*a* are spaced axially between LEDS 71 and 73 but are spaced upwardly from the track a distance greater than the diameter of a dime and less than the diameter of a nickel. LED 75 and its associated phototransistor 75*a* are spaced even farther axially along the chute, and are spaced upwardly from the track a distance just slightly less than the diameter of a nickel, whereas LED 74 and its associated phototransistor 74*a* are spaced axially between LEDs 73 and 75 and upwardly from the track 25 a distance slightly greater than the diameter of a nickel. LED 76 and its associated phototransistor 76*a* are spaced farthest along the chute and are spaced upwardly from the track 25 a distance slightly less than the diameter of a quarter.

The LEDs 71–76 and their associated phototransistors 71*a*–76*a* are operatively connected in a solid state circuit with LED 35 and its associated phototransistor 37, previously described, and which are positioned farther down the chute and spaced upwardly only approximately ¼ inch from the track 25. Thus, a coin or slug and the like moving down the chute interrupts certain LEDS and their associated phototransistors to energize the circuit and control operation of solenoid 43 to thus control the position of gate 39, as described in connection with the form of the invention illustrated in FIGS. 2–17.

Figure 22:
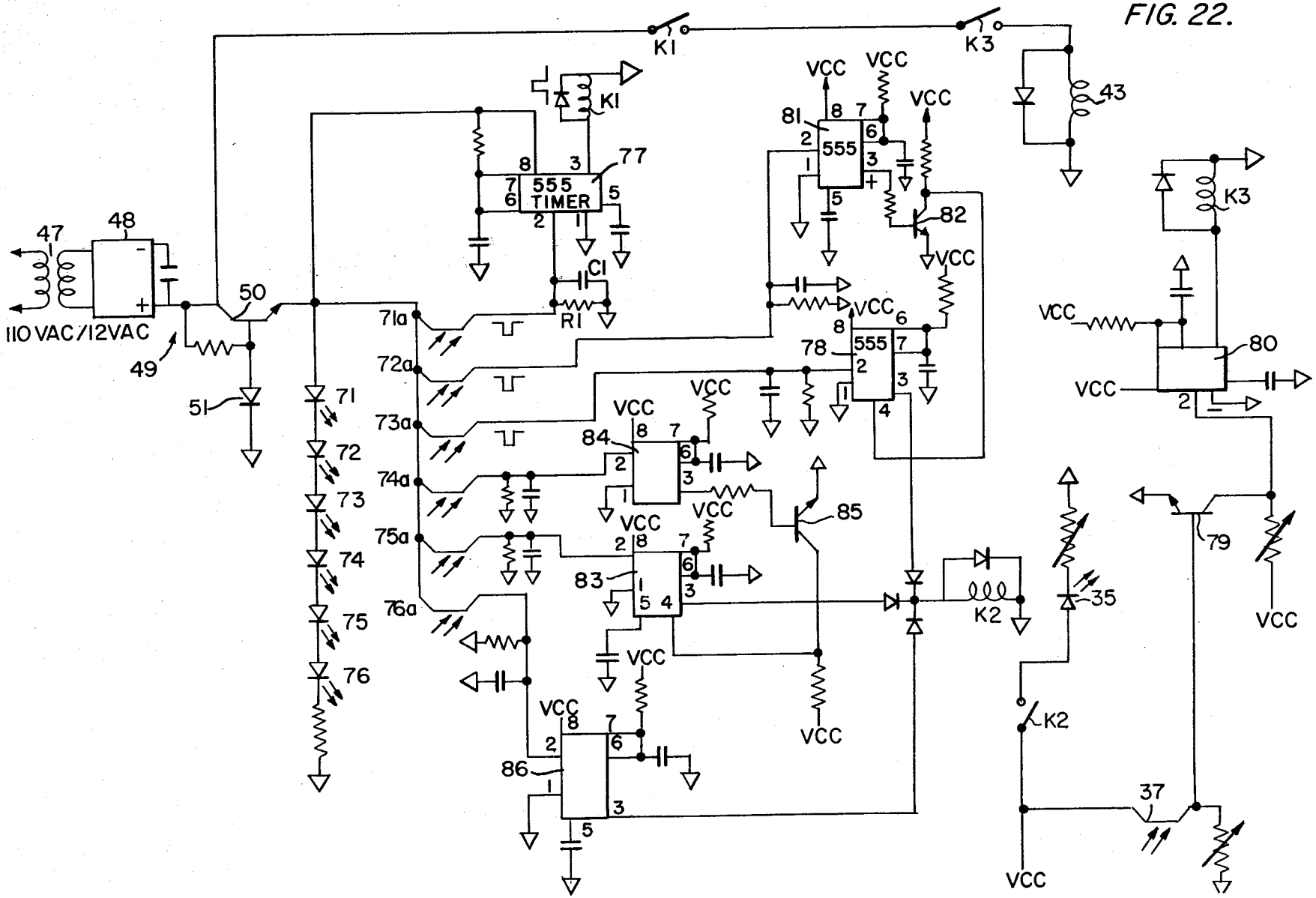
FIG. 22 is a circuit diagram of the solid state circuit used with the form of the invention shown in FIGS. 20 and 21.

The circuit for controlling operation of the gate 39 is schematically illustrated in FIG. 22, and includes a transformer 47 for stepping the supply voltage down to 12 volts AC and a bridge 48 to rectify the AC voltage to DC voltage. A regulator 49 comprising a power transitor 50 and Zener diode 51 is connected with the output of bridge 48 to maintain a constant voltage to the circuit. The rectified and regulated voltage is then applied to the LEDs 71–76 and their associated phototransistors 71*a*–76*a*. Accordingly, a coin or slug or the like rolling down the chute rolls between LED 71 and its associated phototransistor and interrupts the light therebetween, thus causing the phototransistor to send a negative signal or pulse to pin 2 of a 555 timer 77. If the signal produced by phototransistor 71*a* is of sufficient length as governed by capacitor C1 and resistor R1, which is equivalent to the width or diameter of a dime, the timer 77 turns on, giving an output at pin 3, the duration of which is controlled by the capacitor and resistor at pins 6 and 7. This output pulls in relay K1, thus supplying voltage to relay K3. Thus, a coin or token and the like must have an uninterrupted diameter at least as great as a dime in order to provide a pulse of electrical energy of sufficient duration to operate the relay K3, since a slug or the like having a hole therein will not produce a pulse of the proper duration to turn timer 77 on and energize relay K1. If, for example, this coin is a dime, it continues rolling down the chute past the LED 72 and without blocking the light from LED 72 to its phototransistor 72*a*, and then past LED 73, blocking the light from LED 73 to its phototransistor 73*a*. The phototransistor 73*a* thus sends a negative signal to pin 2 of 555 timer 78, turning it on and giving an output at pin 3, the duration of which is governed by the resistor and capacitor at pins 6 and 7. This output then pulls in relay K2, supplying voltage to LED 35 and phototransistor 37. When the dime rolls past LED 35 and phototransistor 37, light is reflected to the phototransistor 37 sending a positive signal to transistor 79, turning off the transistor and sending a negative signal to pin 2 of 555 chip 80, turning the 555 chip or timer on to operate relay K3, and thus supply voltage to solenoid 43 to actuate gate 39 to its said second position.

if anything larger than a dime rolls down the chute 21′, it will interrupt the light from LED 72 to phototransistor 72*a*, and thus cause a signal to be sent to 555 timer 81, turning it on and giving a positive output from pin 3 to a transistor 82, turning off the transistor and thus sending a negative signal to the reset pin 4 of 555 timer 78, thus keeping it from turning on when the coin subsequently passes LED 73.

A nickel proceeds in the same way as a dime rolling down the chute 21′. In other words, if the coin is a nickel, it produces a long enough pulse in passing LED 71 to close relay K1 and supply voltage to relay K3. Also, the nickel will pass beneath LED 74 and will interrupt light from LED 75 to phototransistor 75*a*, thus sending a positive pulse to 555 timer 83, the output of which energizes or closes relay K2 to supply power to LED 35 and phototransistor 37. The operation of the circuit to energize solenoid 43 upon a nickel passing LED 35 and phototransistor 37 is the same as with a dime. If, on the other hand, the coin is larger than a nickel but smaller than a quarter, it will interrupt the light from LED 74 to phototransistor 74*a*, sending a positive pulse to 555 timer 84, which will send its output to a transistor 85, turning off the transistor and sending a negative pulse to the reset of timer 83, such that when the coin passes LED 75, it will not turn timer 83 on and the relay k2 will thus not be closed and power will not be supplied to LED 35 and phototransistor 37.

A quarter will, of course, interrupt the light from LED 76 to its phototransistor 76*a*, and send a positive pulse to 555 timer 86, the output of which closes relay k2 to supply voltage to LED 35 and its phototransistor 37. Anything larger than a quarter cannot be inserted into the chute because of the size limitations of the coin insert slot in the machine.

Figure 21:
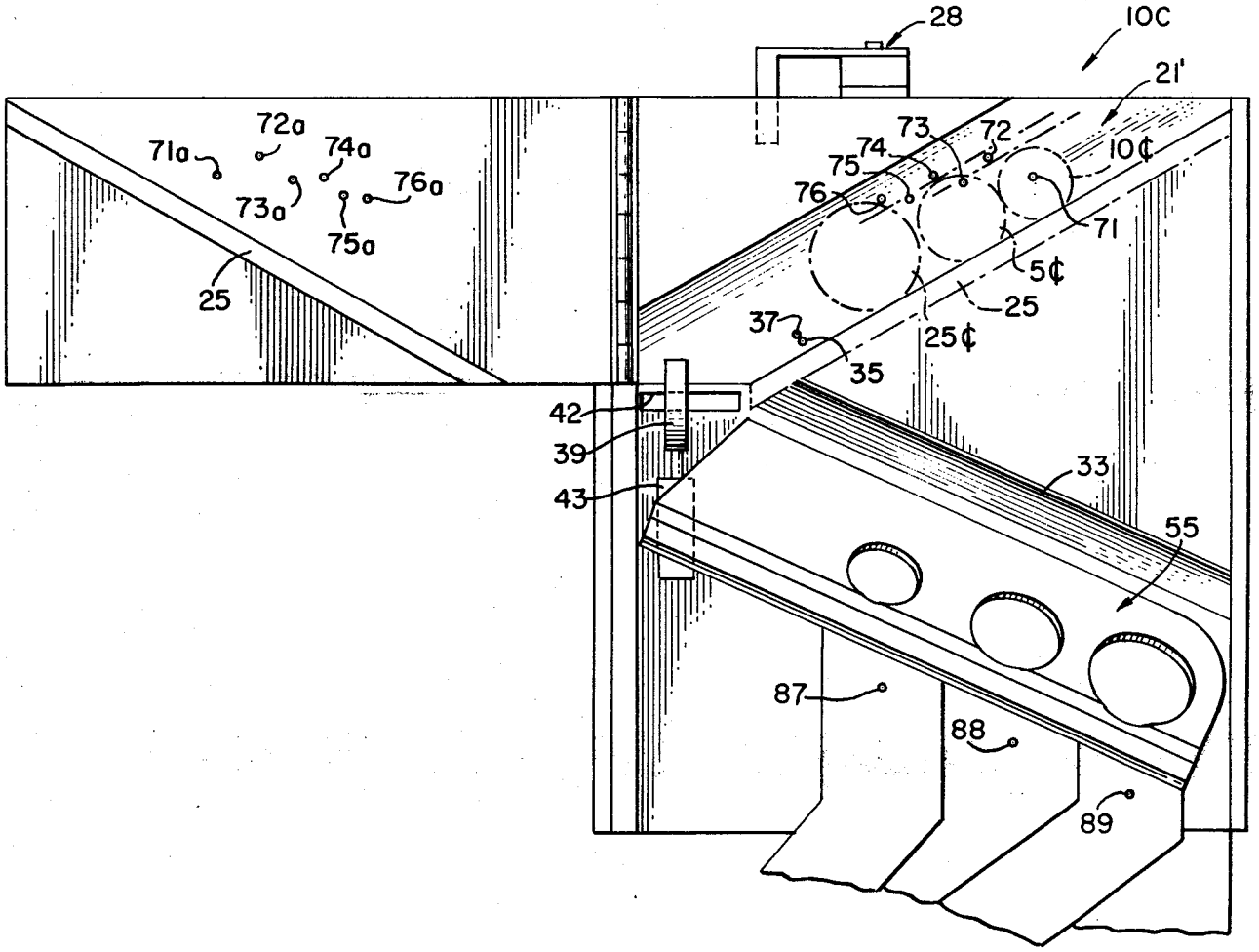
FIG. 21 is a view similar to FIG. 20 of yet a further modification, wherein further light emitting means and light sensitive means are associated with the coin dropout chutes leading from the dropout platform for counting or accumulating the value of coins dropped therethrough, to thus determine the initiation of activation of the mechanism controlled thereby.

A further modified rejector 10C is illustrated in FIG. 21 and is substantially the same as rejector 10B, except that LEDs 87, 88 and 89 and associated phototransistors 87*a*, 88*a* and 89*a* are operatively associated with the coin dropout chutes 66, 67 and 68 leading from the dropout platform 55′ to indicate the total value of coins fed to the mechanism. The LEDs and phototransistors are operatively connected in a solid state circuit 90, illustrated schematically in FIG. 23.

When a dime passes between LED 87 and its associated phototransistor 87a, the light is blocked and phototransistor 87a sends a negative signal to pin 2 of 555 timer 91, turning the timer 91 on. Timer 91 thus gives an output at pin 3, pulling in relay K4, which closes, allowing current to be supplied to resistors 92, charging the capacitor 93. The duration of the output from timer 91 is governed by the resistance and capacitance at pins 6 and 7 of timer 91, and this time is set to equal twice the duration of a pulse or signal from a timer 94 and two-fifths the duration of the pulse or signal of a timer 95. The amount of resistance set in resistors 92 establishes the number of times a dime must by the LED 87 and phototransistor 87a in order to fully charge the capacitor 93. In other words, depending upon the value of the item or service to be dispensed by the mechanism, the number of coins necessary to fully charge the capacitor 93 and the value of the coins can be easily and accurately established in the circuit. When the capacitor 93 is fully charged, it discharges firing a programmable unijunction transistor 96, causing SCR 97 to fire, putting a momentary negative signal at the anode, which then turns on a 555 timer 98, whose output at pin 3 pulls in relay K5, supplying voltage to any desired device for use as needed or desired. The dime then proceeds on down the chute 87 to drop into a coin box or escrow unit or the like, whichever is applicable or desired.

A nickel or quarter both proceed in essentially, the same way, turning on, respectively, timers 94 and 95 to pull in relay K4 and supply current to capacitor 93 through resistor 92. The resistance and capacitance at the pins 6 and 7 of timers 94 and 95 are selected to give a pulse duration equivalent to a nickel or quarter, respectively. In other words, the pulse duration of timer 91 is two-fifths, the pulse duration of timer 94 is one-fifth and the pulse duration of timer is five-fifths, and the value of the resistance 92 is set to control the total valuation required to fully charge capacitor 93.

Figure 23:
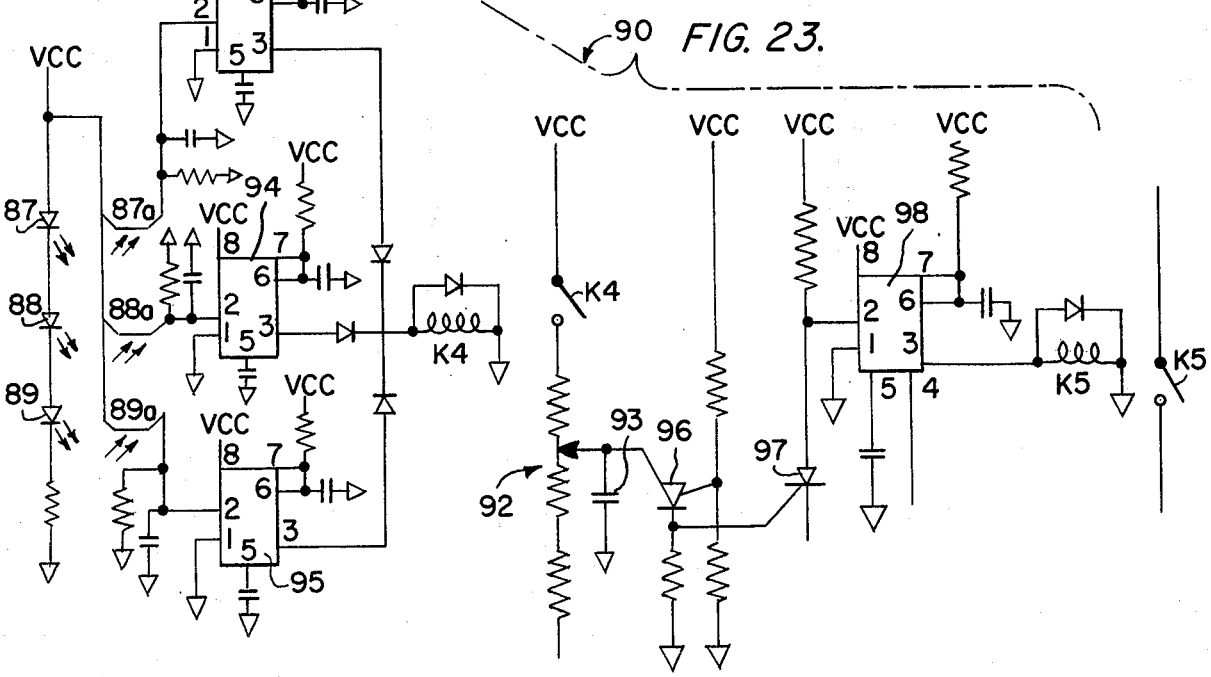
FIG. 23 is a circuit diagram of the solid state circuit used with the accumulating portion of the form of the invention of FIG. 21.

The accumulating circuit of FIG. 23 can obviously be used with any of the forms of the invention described herein. Moreover, the components comprising the rejector according to the invention may be made of any suitable material, such as plastic and metal and the like.

Thus, as can be seen, an economical and highly efficient and accurate coin rejector is provided, and a coin, washer, or a token with hole passing by LED 71 will not give a long enough signal to turn on timer 77 and relay K1 will thus not be pulled in and power will not be supplied to operate solenoid 43, and the improper coin or washer and the like will fall through slot 42 to the coin return. Also, a washer, slug or coin and the like that does not have an irregular or raised surface or sufficient brightness will not reflect light from LED 35 to phototransistor 37, and the relay K3 will thus not be pulled in to supply power to energize solenoid 43, and the washer, coin or slug and the like will fall through slot 42 to the coin return.

Additionally, when the power is off to the unit, coins passing the LEDs will not produce any pulses and the solenoid 43 will not be energized, and the coins will return through slot 42 to the coin return.

The device 28 is used to spread apart the back plate and front plate in the event that a bent coin or washer, token and the like is caught in the chute, thus releasing such bent coin or washer and the like, which falls to the rail 33 and drops through slot 34 to the coin return.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. Coin rejector means, comprising: a downwardly inclined coin feed chute; means constraining a coin to move along said chute; light emitting means at one side of the chute directed across the path of travel of a coin moving along the chute; signal-producing light sensitive means at said one side of the chute adjacent the light emitting means and aimed to receive light reflected from a bona fide coin of predetermined reflectivity moving past the light emitting means and to produce a signal; said chute having means operatively associated with the light emitting means and the light sensitive means to preclude signal-producing reflection of light to the light sensitive means from an improper coin and the like which has less than the predetermined reflectivity; and gate means operative in response to a signal from the light sensitive means to pass a bona fide coin of selected value and to reject a slug or coin and the like of improper value.

2. Coin rejector means as in claim 1, wherein said means constraining a coin to move along said chute includes a track disposed along a bottom edge of said chute and having an upper coin supporting surface for supporting a coin for rolling movement along said track and chute, said rejector means comprising a housing including a front plate having a front surface and a rear surface, a back plate disposed in overlying relationship to said rear surface, said chute comprising a recessed portion in the rear surface of said front plate, and said track carried by said back plate, and normally operatively disposed in engagement with said rear surface at the bottom edge of said chute and being movable away from said rear surface to release a coin lodged in said chute.

3. Coin rejector means as in claim 2, wherein an inclined rail is carried by the rear surface of said front plate spaced below the chute for receiving coins dislodged or released from the chute upon movement of the track away from said rear surface, said rail downwardly inclined for supporting the dislodged coins and the like for downward movement to a coin return means.

4. Coin rejector means as in claim 1, wherein said rejector means comprises a housing including a front plate and a rear plate, said front plate having front and rear surfaces, and said rear surface having a recessed area therein defining an inclined side wall of said chute, coin supporting track means carried by the back plate and disposed at the bottom edge of said side wall to provide support for a coin rolling along said track, with the coin in sliding engagement with the side wall.

5. Coin rejector means as in claim 1, wherein said gate means comprises a pivoted deflector means at a lower end of said chute pivotal to a first position to deflect improper coins through a coin return means and pivotal to a second position to deflect coins into a coin activated means to initiate dispensing of a goods or service and the like, operating means connected with said gate means to operate it to its said two positions, and control means connected with said light emitting means and with said operating means to control operation of said gate means responsive to a signal from the light emitting means, said operating means comprising a solenoid operatively connected with the gate means to move the gate means to its said two positions, and having a de-energized position with the gate means in its said first position, and an energized position in response to a signal from the light sensitive means, with the gate means in its said second position.

6. Coin rejector means as in claim 5, wherein said control means includes a solid state circuit connected between the light sensitive means and the solenoid means, said light emitting means comprising a LED and said light sensitive means comprising a phototransistor, a transistor connected with the phototransistor, such that when light is relfected to the phototransistor, it goes positive, and the positive signal from the phototransistor turns off the transistor, said transistor being connected with a 555 timer to turn on the timer upon receipt of the positive signal from the phototransistor, said timer being in turn connected with a further transistor to fire said further transistor, and said solenoid being connected with said further transistor, whereby when said further transistor is fired, said solenoid is energized.

7. Coin rejector means as in claim 4, wherein said side wall has an opening therethrough of predetermined size smaller than the diameter of a dime, such that any coin or slug and the like rolling along the chute of smaller size than a dime falls through said opening to a coin return means.

8. Coin rejector means as in claim 7, wherein a stop surface is formed in said side wall in spaced relation to said track, said stop surface being spaced from the track a distance greater than the diameter of a dime and less than the diameter of a nickel, such that any coin or slug and the like having a diameter between the diameters of a dime and a nickel will engage said stop surface and be precluded from further advancement along said chute.

9. Coin rejector means as in claim 5, wherein a coin dropout platform is disposed beneath said chute in a position to receive coins diverted by said gate means when the gate means is in its said second position, said dropout platform including an inclined side wall having a plurality of openings therethrough corresponding in shape and size to predetermined denominations of coins, and coin support track means along the bottom edge of said inclined wall, such that coins are constrained to roll along said track means in sliding engagement with said wall, whereby coins of proper denomination fall through openings of predetermined size to thus initiate activation of a coin controlled mechanism, and means on said track means to momentarily impede movement of coins along said track means to thus facilitate dropping of proper coins through the respective openings.

10. Coin discriminating apparatus, comprising: a downwardly inclined coin feed chute; means constraining a coin to move along the chute, said chute including a side wall at one side thereof lying in a plane inclined to the vertical and having an upper end and a lower end and having coin supporting track along a lower edge thereof such that a coin rolls along the track from the upper end to the lower end with one side of the coin in sliding contact with the side wall, said side wall having an opening therethrough of predetermined size; said side wall having a recess therein defining a coin stop shoulder spiced below the sidewall upper edge and situated adjacent said opening, said shoulder spaced a predetermined distance upwardly from the track, whereby coins and the like rolling along the track and which have a size less than the predetermined size of the opening will fall through the opening to a coin return means, and coins which have a size a predetermined amount greater than the size of the opening but not greater than the distance from the track to the shoulder will engage the shoulder and be prevented from further advancement through the apparatus, and coins which have a size greater than the distance from the track to the shoulder will ride over the shoulder and not be stopped thereby.

11. Coin discriminating apparatus as in claim 10, wherein said track is movably supported for movement away from said side wall to release a coin engaged with said stop surface.

12. Coin discriminating apparatus as in claim 11, wherein a coin supporting rail is disposed below said chute fro receiving a coin released from the chute upon movement of the track away from the side wall, said rail supporting a coin for movement to a coin return means.

13. Coin discriminating apparatus as in claim 12, wherein light emitting means and light sensitive means are disposed closely adjacent one another at one side of the chute and are pointed angularly toward one another, such that a coin of the proper size moving along the chute interrupts the light from the light emitting means, and means associated with the light emitting means and light sensitive means to preclude reflection of light from an improper coin or slug and the like to the light sensitive means and operative to enable reflection of light from a bona fide coin to the light sensitive means, gate means at a lower end of said chute and operative to a first position to divert coins to a coin return means, and operative to a second position to deflect coins further into the apparatus to initiate operation of a goods or service dispensing means, and control means connected between the light sensitive means and gate means to control operation of the gate means to its said two positions dependent upon the reflection of light from a coin and the like moving past said light emitting means and light sensitive means.

14. Coin discriminating apparatus as in claim 12 wherein said apparatus includes a front plate and a rear plate movable toward and away from the front plate, said track carried by the rear plate for movement therewith to thus release coins lodged in the chute.

15. Coin discriminating apparatus as in claim 13, wherein a coin dropout platform is spaced below said chute, with one end thereof disposed adjacent said gate means to receive coins deflected by said gate means in the second position of the gate means, said dropout platform having an inclined side wall with a plurality of spaced apart openings therein of predetermined size and shape corresponding to different value coins, and coin supporting track means extending along a bottom edge of said side wall for supporting coins for rolling movement along said dropout platform, with the coins in sliding contact with said side wall to facilitate dropping of said coins through respective openings.

16. Coin discriminating apparatus comprising: a downwardly inclined coin feed chute, means constraining a coin to move along the chute, said chute including a side wall at one side thereof inclined to the vertical and having a coin supporting track along a lower edge thereof such that a coin rolls along the track with one side of the coin in sliding contact with the side wall, said side wall having a plurality of openings therethrough in predetermined spaced relation from the track and axially along the chute; an LED assoicated with each opening and aimed outwardly across the path of advancement of a coin and the like moving along said chute; a corresponding number of signal producing light sensitive devices on the other side of the chute, each in alignment with a respective LED; gate means at a lower end of the chute operative in one position to divert coins and the like of improper value to a coin reject slot and operative in another position to divert coins further into the apparatus for effecting operation of a desired device; said light sensitive devices operatively connected with means for operating said gate means, and spaced such that only bona fide dimes, nickels and quarters will effect operation of the gate means to its said another position to thus enable the coins to effect operation of the desired device.

17. Coin discriminating apparatus as in claim 16, wherein there are six LEDs and corresponding light sensitive devices spaced along the chute, including a first LED and corresponding light sensitive device spaced closest to the entrance to said chute and spaced a first distance from the track, such that the first LED and light sensitive device are at approximately the level of the midpoint of a dime moving along said chute, said means for operating said gate means including control means connected with said first LED and light sensitive means to produce a signal of predetermined duration by a coin moving between the first LED and corresponding light sensitive means, said control means including first timer means and a relay operatively connected such that said signal of predetermined duration is controlled through said first timer means to effect operation of said relay; a second LED and corresponding light sensitive means spaced form the first LED and spaced from the track a distance greater than the diameter of a dime and connected with a second timer means to send a signal to said second timer means and turn said second timer means on when a coin larger than a dime interrupts the light from the second LED to its corresponding light sensitive means, and a third timer means connected with said second timer means, whereby when said second timer means is turned on, it controls application of a signal to the third timer means to reset the third timer means and prevent the third timer means from turning on; a third LED and corresponding light sensitive means spaced axially of the second LED and spaced from the track a distance only slightly less than the diameter of a dime, and operatively connected with the third timer means, such that when a dime interrupts the light from the third LED to its corresponding light sensitive means, a signal is sent to the third timer means to turn the third timer means on; gate operating means operatively connected with the output of said third timer means and connected with said gate means to operate said gate means; fourth and fifth spaced LEDs and corresponding light sensitive means arranged similarly to said second and third LEDs to detect the presence of a nickel moving along said chute to operate said gate means to its second position and to detect the presence of a coin of slug and the like larger than a nickel to prevent operation of said gate means; and a sixth LED and corresponding light sensitive means spaced from the track to sense the presence of a quarter to operate said gate means.

18. Coin discriminating apparatus as in claim 17, wherein a seventh LED and an associated light sensitive means are disposed at one side of the chute means spaced from said sixth LED and its associated light sensitive means and angularly pointed toward one another, such that when a coin of proper reflectivity moves past said seventh LED and its associated light sensitive means, light is reflected from said coin to the associated light sensitive means to produce a signal, said gate operating means comprising a solenoid, solenoid control means connected to receive said signal and operative in response thereto to supply electrical energy to said solenoid to operate said gate means, such that said gate means is only operated if a coin having the proper reflectivity moves down said chute, thus insuring that the gate means will not be operated upon introduction into the chute of a counterfeit or improper coin or slug and the like.

19. Coin discriminating aparatus as in claim 16, wherein a coin dropout platform is spaced below said chute and has an inlet end thereof adjacent said gate means to receive coins which pass down said chute and through said gate means, said dropout platform having a coin supporting rail along a lower edge thereof and an inclined side wall on which the coins are slidably engaged as they roll along said coin support track, and said side wall having a plurality of openings therethrough corresponding in size and shape to the size and shape of a dime, nickel and quarter, respectively, such that a dime, nickel or quarter rolling down said dropout platform will fall through the respective hole, and a coin dropout chute leading from each hole for guiding a coin from a respective hole to a coin holding means.

20. Coin discriminating apparatus as in claim 19, wherein an LED and associated light sensitive means are situated at opposite sides respectively of each of the coin dropout chutes to sense the presence of a coin falling therethrough, and operatively connected with suitable circuit means to accumulate signals generated by coins falling through the dropout chutes to indicate when a desired valuation of coins have been fed to the apparatus to initiate operation of a dispensing means.

21. Coin discriminating means as in claim 16, wherein said coin discriminating apparatus comprises a houding, said housing including a front plate and a rear plate pivotally mounted relative to the front plate for movement toward and away therefrom, coin support track means carried by said rear plate and normally operatively disposed at the bottom edge of said chute to support a coin moving along said chute, and movable away from said front plate to release coins from said chute which have beome lodged therein, coin return rail means carried by the front plate spaced below the chute to receive the released coins and guide them to a coin return means, and a quarter stop solenoid carried by the back plate and having a plunger operatively movable into the chute into the path of advancement of a quarter therethrough to stop advancement of the quarter when there is not proper change in the machine.

22. A coin rejector, comprising: a housing including a front plate having a front surface and a rear surface, a back plate disposed in overlying relationship to the rear surface of the front plate; said rear surface having a recessed area therein defining an inclined side wall, and said recessed area defining with said back plate a coin feed chute; a coin support track at a bottom edge of the side wall to support a coin for rolling movement along the chute; gate means at a lower end of the chute and operative in a first position to divert coins to a coin return means and operative in a second position to divert coins into a coin activated mechanism to initiate dispensing of a goods or service and the like; operating means connected with the gate means to operate the gate means to its said first and second positions; control means connected with the operating means to control operation of the gate means, said control means including light emitting means and light sensitive means disposed closely adjacent one another at one side of the chute and pointed angularly toward one another such that a bona fide coin moving along the chute past the light emitting means will reflect light to the leight sensitive means to cause operation of the gate means to its said second position; and means including said side wall, to preclude reflection of light from a slug or improper coin, whereby said gate means is operated to its said first position.

23. Coin controlled mechanism for vending machines and the like, comprising: a rejector for discriminating between bona fide and improper coins and the like and rejecting coins of improper value and slugs and the like and passing bona fide coins of proper value; said rejector being attachable to a conventional coin operated mechanism to insure supply of only proper coins thereto, and including a housing having a front plate with a front surface and a back surface, a back plate pivotally connected thereto and adapted to lie flatwise against the back surface, and a cover plate covering the back plate, said front plate having a recessed area in the back surface thereof inclined downwardly from an upper edge of the front plate adjacent one side edge thereof to the other side edge thereof and with said back plate defining a coin feed chute having an inclined side wall; a coin support track carried by the back plate in a position to engage the back surface of the front plate at and along the bottom edge of the chute side wall to support a coin for rolling movement therealong, said track being selectively movable away from said back surface with said back plate to thus release a coin which becomes lodged in said chute; a coin supporting rail carried on the back surface of the front plate spaced below the chute, such that when a lodged coin and the like is released from the chute, it is caught by the rail and conveyed thereby to a coin return means; coin size discriminating means operatively associated with said chute to effect rejection of improper coins fed thereto; said chute side wall having a pair of closely spaced openings therein adjacent the bottom edge thereof; a LED positioned in association with one of the openings to project light across the path of movement of a coin moving along said chute, and a signal producing light sensitive means operatively positioned at the other opening, said LED and light sensitive means pointed angularly toward one another, whereby light from the LED is reflected off of a bona fide coin to the light sensitive means to thus produce a signal; a gate means at a lower end portion of the chute selectively operative to divert an improper coin to a coin return means and to divert a proper coin further into the mechanism; and operating means connected with said gate means responsive to the signals produced by the light sensitive means to operate the gate means in response to a coin and the like interrupting the light from the LED.

24. Coin discriminating apparatus comprising: a downwardly inclined coin feed chute, means constraining a coin to move along the chute, said chute including a side wall at one side thereof and having a coin supporting track along a lower edge thereof, said side wall having a plurality of openings therethrough each spaced a predetermined distance from the track and also spaced apart axially along the chute; a light emitting means associated with each opening and aimed outwardly across the path of advancement of a coin and the like moving along said chute; a corresponding number of signal producing light sensitive devices on the other side of the chute, each in alignment with a respective light emitting means; gate means at a lower end of the chute operative in one position to divert coins and the like of improper value to a coin reject slot and operative in another position to divert coins further into the apparatus for effecting operation of a desired device; said light sensitive devices operatively connected with means for operating said gate means, and spaced such that only bona fide coins of predetermined value will effect operation of the gate means to its said another position to thus enable the coins to effect operation of the desired device.

* * * * *